US006757933B2

(12) United States Patent
Oh et al.

(10) Patent No.: US 6,757,933 B2
(45) Date of Patent: Jul. 6, 2004

(54) CYCLONE DUST COLLECTING APPARATUS AND UPRIGHT VACUUM CLEANER

(75) Inventors: Jang-keun Oh, Gwangju (KR); Jung-seon Park, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 314 days.

(21) Appl. No.: 10/083,087

(22) Filed: Feb. 26, 2002

(65) Prior Publication Data

US 2003/0019074 A1 Jan. 30, 2003

(30) Foreign Application Priority Data

Jul. 25, 2001 (KR) ..... 2001-44753

(51) Int. Cl.[7] ..... A47L 9/16

(52) U.S. Cl. ..... 15/353; 15/352; 15/347; 55/337; 55/429; 55/459.1; 55/DIG. 3

(58) Field of Search ..... 15/347, 350–353; 55/337, 418, 429, 459.1, 504

(56) References Cited

U.S. PATENT DOCUMENTS 6,613,116 B2 * 9/2003 Oh ..... 55/134
6,648,934 B2 * 11/2003 Choi et al. ..... 55/337
6,660,053 B2 * 12/2003 Oh et al. ..... 55/337
2003/0014952 A1 * 1/2003 Oh et al. ..... 55/337
2003/0014953 A1 * 1/2003 Oh ..... 55/337
2003/0066273 A1 * 4/2003 Choi et al. ..... 55/337
2003/0106182 A1 * 6/2003 Lee ..... 15/353

FOREIGN PATENT DOCUMENTS

EP 0928594 7/1999
EP 0972573 1/2000

* cited by examiner

*Primary Examiner*—Terrence R. Till
(74) *Attorney, Agent, or Firm*—Ladas & Parry

(57) ABSTRACT

A cyclone dust collecting apparatus that includes a cyclone body that has an inflow passage and a outflow passage, and is removably connected with a cleaner body; a grill body that has a connection passage for being connected with the outflow passage; a shielding member removably connected with the grill body in order to shield a lower opening of the grill body; a dust collector removably connected with a lower part of the cyclone body in order to collect dust separated in the cyclone body; and a blocking member for preventing the dust collector from being connected with the cyclone body when the shielding member is not assembled at the grill body. Also, an upright vacuum cleaner which utilizes the apparatus.

11 Claims, 6 Drawing Sheets

CYCLONE DUST COLLECTING APPARATUS AND UPRIGHT VACUUM CLEANER

BACKGROUND OF THE INVENTION

1. Field of the Invention

The present invention relates to a cyclone dust collecting apparatus and an upright vacuum cleaner that includes the apparatus.

2. Description of the Related Art

A conventional cyclone dust collecting apparatus 10 for a vacuum cleaner shown in FIG. 1 comprises a cyclone body 20, a dust collector 30, and a grill assembly 40. The grill assembly 40 is connected with the cyclone body 20 by a connection member (not shown).

An inflow passage 21 connected with a brush assembly (not shown) of the vacuum cleaner is disposed at an upper part of the cyclone body 20. Air drawn into through the inflow passage 21 flows in a tangential direction of the cyclone body 20 and forms a whirling air current.

An outflow passage 22 is disposed at an upper center of the cyclone body 20. A grill assembly 40 for preventing a dust from being drawing into a vacuum generating device, that is, a motor driving unit, is disposed at an inlet of the outflow passage 22.

The grill assembly 40 has a grill body 41 and a sealing member 42. The grill body 41 has a plurality of passages 46 formed therein, in order to draw in the air. A dust back flow preventing unit 43 is formed on an outer side of a circumferential direction of the sealing member 42.

An upper part of the grill body 41 is connected with the outflow passage 22, and a lower part of the grill body 41 is shielded by the shielding member 42.

The shielding member 42 is removably connected with the grill body 41 by a screw 45.

In the above construction, a user separates the cyclone dust collecting apparatus 10 from the vacuum cleaner to cleanse or repair the cyclone dust collecting apparatus. Then, the user should separate the dust collector 30 from the cyclone body 20, and the shielding member 42 from the grill body 41. After finishing cleaning and repairing of the cyclone dust collecting apparatus, the shielding member 42 should be reassembled. Next, the dust collector 30 is reassembled, and finally, the cyclone dust collecting apparatus 10 should be reinstalled at the cleaner.

An upright vacuum cleaner is disclosed in Korean patent application number 2001-31233, which has not been published as of the filing date of the US application for the present invention. In the disclosed vacuum cleaner, the cyclone body is secured to the vacuum cleaner by a locking knob, and the dust collector is removably installed at a lower part of the cyclone body by a locking unit. In the vacuum cleaner having the above construction, only the dust collector is separated and reinstalled without separating the cyclone dust collecting apparatus from the vacuum cleaner, when the user removes dust. Thus, it is convenient for the user to use the vacuum cleaner.

On the other hand, when the cyclone dust collecting apparatus of FIG. 1 is applied to an upright vacuum cleaner by using the advantage of the vacuum cleaner disclosed as the above-mentioned unpublished application, there is an advantage of high dust collecting effect and the user also can use the vacuum cleaner conveniently.

However, if the dust collector 30 is removably connected with the cyclone body 20 in a construction of FIG. 1, the vacuum cleaner can be operated in the status that the shielding member 42 is not assembled at the grill body 41 due to the user's mistake. In this case, the dust can be directly drawn into the motor driving unit through a lower opening of the grill body 41. Thus, improvements in this design and construction are needed.

SUMMARY OF THE INVENTION

The present invention relates to a cyclone dust collecting apparatus and an upright vacuum cleaner that contains the same. The apparatus has an improved structure that prevents the dust collector from being assembled when the shielding member is not previously assembled into the grill body.

This is accomplished by providing a cyclone dust collecting apparatus for an upright vacuum cleaner that comprises a cyclone body that has an inflow passage and a outflow passage, and is removably connected with a cleaner body; a grill body that has a connection passage for connection with the outflow passage; a shielding member removably connected with the grill body in order to shield a lower opening of the grill body; a dust collector removably connected with a lower part of the cyclone body in order to collect dust separated in the cyclone body; and blocking means for preventing the dust collector from being connected with the cyclone body when the shielding member is not assembled at the grill body.

It is preferable that the blocking means includes: a stopper pin disposed at the grill body for moving upwardly and downwardly in order to prevent the dust collector from moving horizontally by protruding to a lower end of the cyclone body when the stopper pin moves downwardly; and a spring for flexibly pressing the stopper pin downwardly. Thus, the stopper pin is pushed to move upwardly by the shielding member connected with the grill body.

In addition, the grill body includes a guide unit for guiding the movement of the stopper pin and accommodating the spring. Moreover, the guide unit has at least one slot formed up and down therein, and a locking member that protrudes from an outer side of the stopper pin. The locking member is connected with the slot in order to prevent the stopper pin from being separated from it.

The invention also relates to an upright vacuum cleaner that comprises a cleaner body that has a settling unit, the settling unit having an outflow path connected with the motor driving unit and an inflow path connected with a suction brush; a cyclone unit installed at the settling unit in order to separate dust from air drawn into through the inflow path, and to discharge the clean air to the outflow path; and a dust collector removably connected with a lower part of the cyclone unit in order to collect the separated dust in a cyclone unit. Preferably, the cyclone unit comprises: a cyclone body, removably connected with the settling unit, having an inflow passage and an outflow passage. A locking knob is rotatably disposed at the cyclone body in order to be removably connected with a knob connection hole formed at an inside wall of the settling unit.

The vacuum cleaner also comprises a grill body having a connection passage connected with the outflow passage; a shielding member removably connected with the grill body in order to shield a lower opening of the grill body; and blocking means for preventing the dust collector from being connected with the cyclone body when the shielding member is not assembled at the grill body. Here, it is preferred that the dust collector be secured by a locking unit that moves upwardly and downwardly, and that the locking unit be disposed at a lower part of the settling unit.

Furthermore, it is advisable that the upright vacuum cleaner comprises a locking lever rotatably disposed at a lower part of the grill body; and a penetrating hole formed at a corresponding part to the shielding member so that the locking lever can pass through at a certain position.

DETAILED DESCRIPTION OF THE PREFERRED EMBODIMENT

The preferred embodiment of the present invention will be described in detail by referring to the appended drawings.

Figure 1:
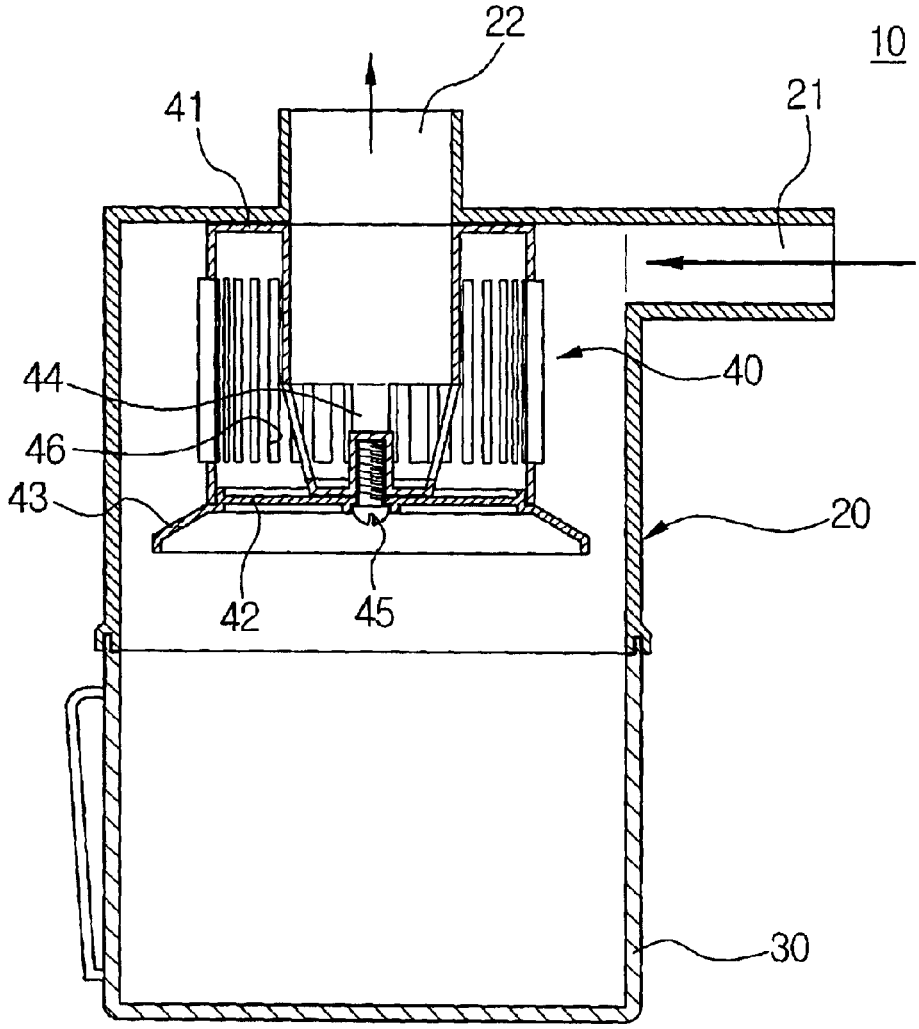
FIG. 1 is a schematic sectional view showing a conventional cyclone dust collecting apparatus.
Figure 2:
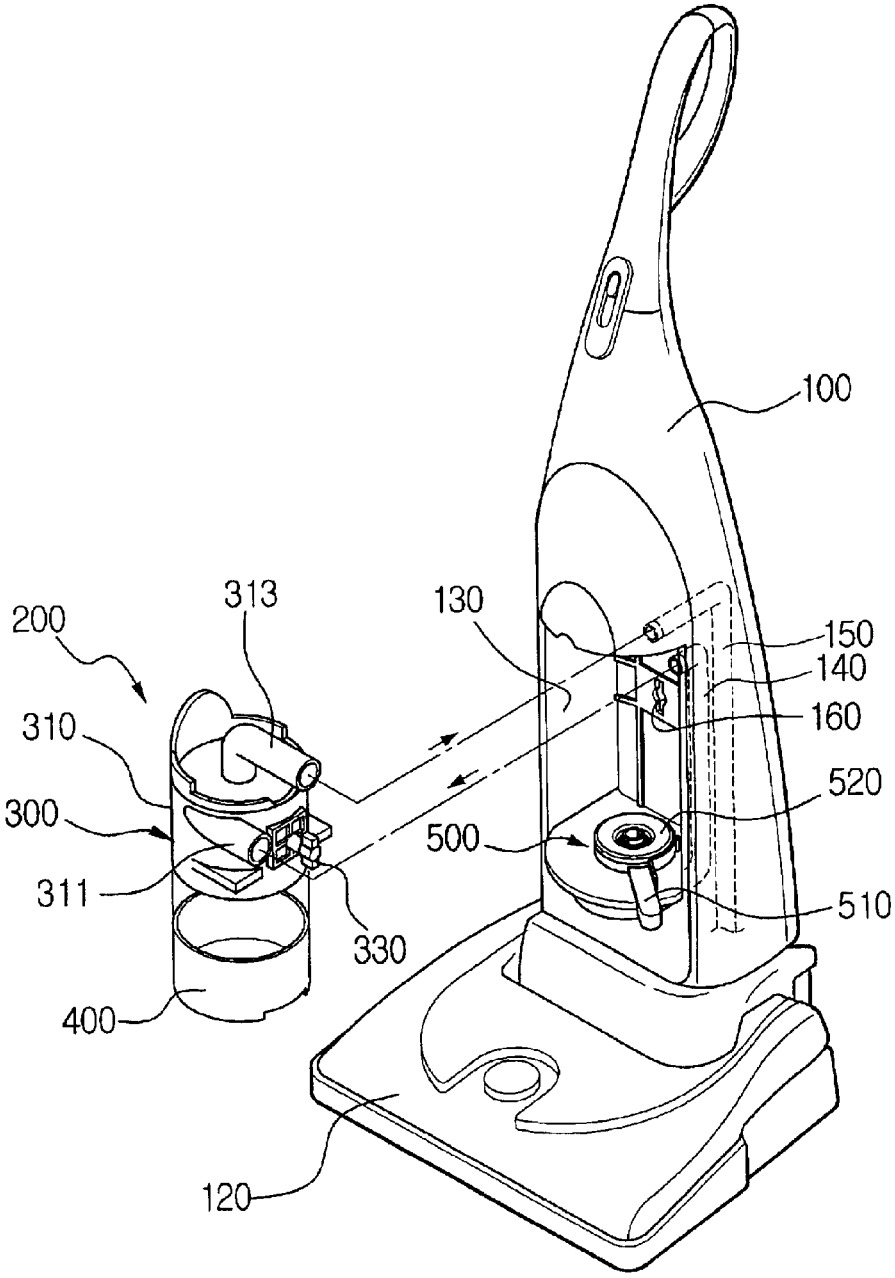
FIG. 2 is an exploded perspective view schematically showing an upright vacuum cleaner according to the preferred embodiment of the present invention.

Referring to FIG. 2, an upright vacuum cleaner according to the preferred embodiment of the present invention comprises a cleaner body 100 and a cyclone dust collecting apparatus 200.

A vacuum generating device (not shown), that is a motor driving unit, is disposed inside of the cleaner body 100. In addition, a suction brush 120 is movably connected with a lower part of the cleaner body 100. A cyclone settling unit 130 is disposed at a front center of the cleaner body 100. An inflow path 140 connected with the suction brush 120 and an outflow path 150 connected with the motor driving unit are disposed inside of the cyclone settling unit 130.

The cyclone dust collecting apparatus 200 comprises a cyclone unit 300 for separating a dust drawn into through the inflow path 140 and discharging the clean air to the outflow path 150, and a dust collector 400 removably connected with a lower part of the cyclone unit 300 in order to collect the separated dust.

The cyclone unit 300 comprises a cyclone body 310 having an inflow passage 311 and an outflow passage 313. Dust drawn into and through the suction brush 120 flows to an inside of the cyclone unit 300 through the inflow path 140 and the inflow passage 311. The inflow passage 311 is disposed for the air drawn into to flow in a tangential direction of the cyclone unit 300. Therefore, the air drawn into through the inflow passage 311 forms a whirling air current along an inside wall of the cyclone unit 300.

Furthermore, the cyclone unit 300 includes a locking knob 330 rotatably disposed at an outer circumference of the cyclone body 310. The locking knob 330 is removably connected with a knob connection hole 160 formed at an inside wall of the cyclone settling unit 130. Thus, when the cyclone body 310 is connected with the cyclone settling unit 130, the user passes the locking knob 330 through the knob connection hole 160 and rotates the locking knob 330 by 90°, so that the cyclone unit 300 is firmly secured to the cleaner body 100. Of course, the locking knob 330 can be released by first rotating back by the same 90°.

Figure 3:
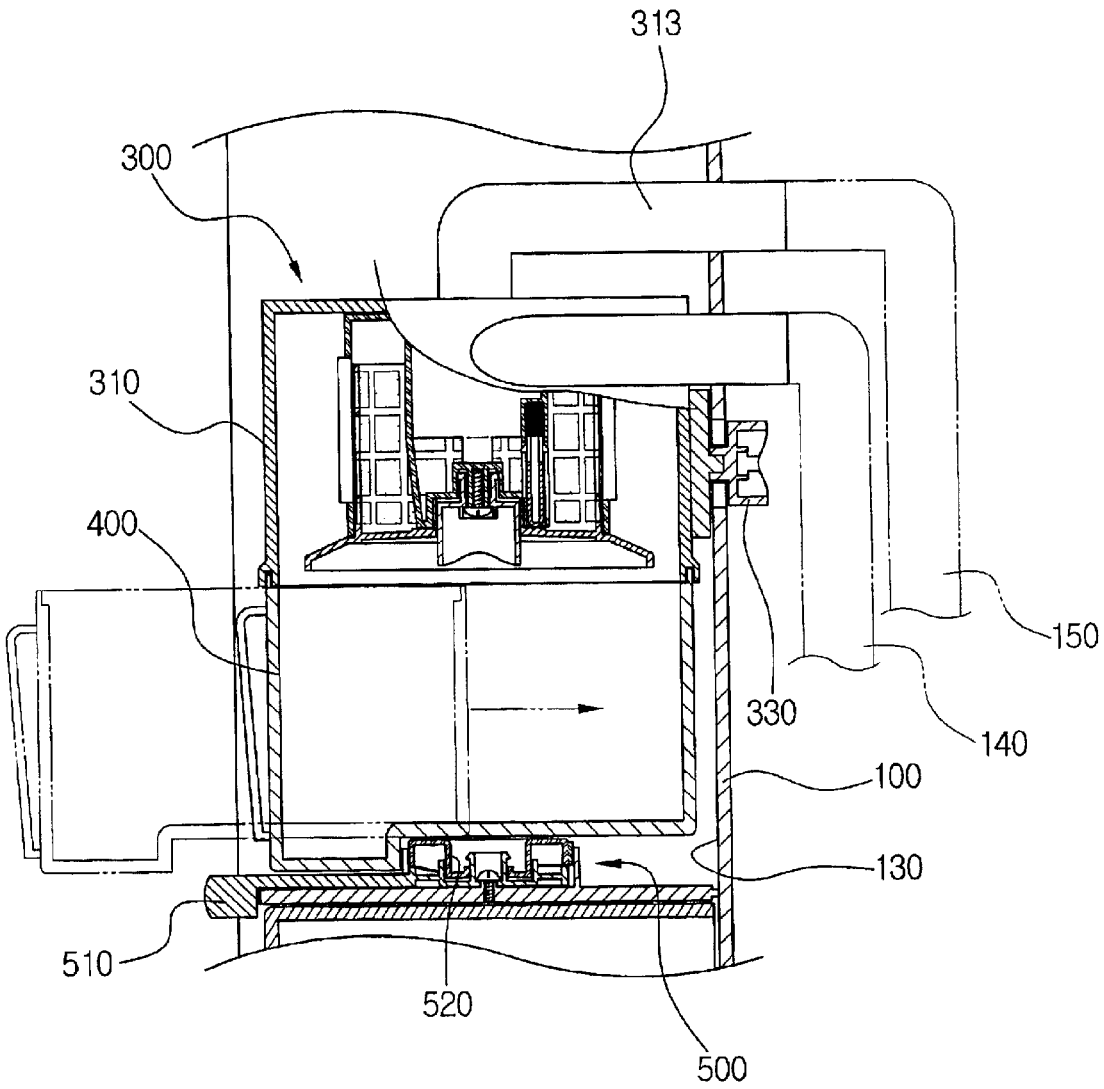
FIG. 3 is a schematic sectional view showing the cyclone dust collecting apparatus of FIG. 2.

Moreover, a locking unit 500 moving upwardly and downwardly is disposed at a lower side of the cyclone settling unit 130. As shown in FIG. 3, the dust collector 400 is removably secured to a lower part of the cyclone unit 300, that is a cyclone body 310 by the locking unit 500. The locking unit 500 has a construction to move a locking disk 520 upwardly and downwardly in accordance with a rotation of a operation lever 510. Accordingly, in the status that the dust collector 400 is mounted on an upper part of the locking unit 500, the dust collector 400 is lifted in accordance with the rotation of the operation lever 510 and adheres to a lower part of the cyclone body 310 or is separated from the cyclone body 310. The construction and the operation of the locking unit 500 is disclosed in further detail in unpublished patent application No. 2001-3123, thus the description about the locking unit 500 will be omitted here.

As described so far, the cyclone unit 300 is secured to the cyclone settling unit 130, and only the dust collector 400 can be separated and installed. In other words, the user moves the dust collector 400 horizontally along a direction of the arrow in FIG. 2, and places the dust collector 400 at the lower part of the cyclone unit 300. Then, the user operates the locking unit 400 to connect the dust collector 400 with the cyclone unit 300. It is preferable that the upper end of the dust collector 400 and the lower end of the cyclone body 310 are sloped to be corresponded to each other for guiding the horizontal movement of the dust collector 400.

Figure 4:
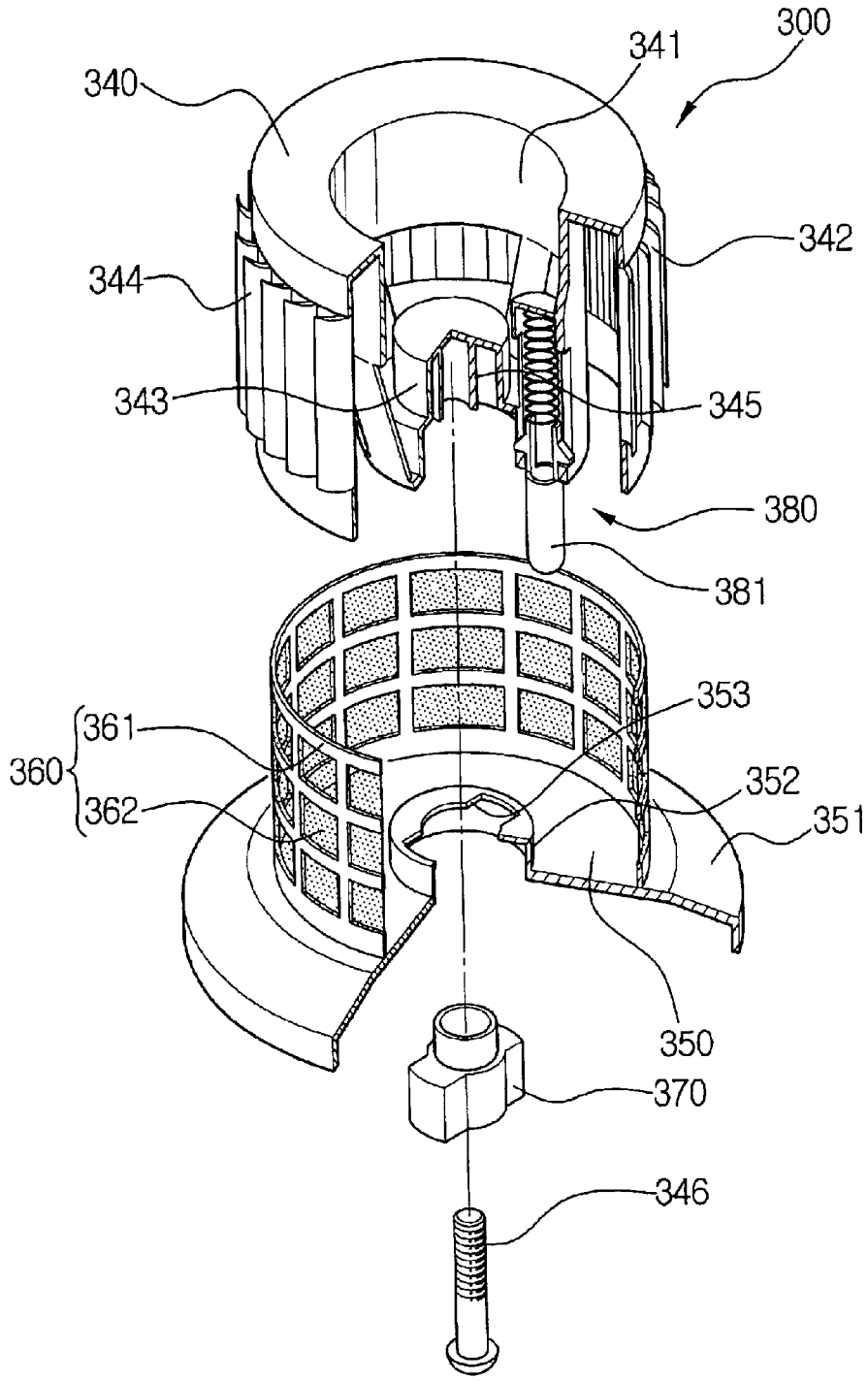
FIG. 4 is an exploded perspective view showing the cyclone unit of FIG. 3.

In addition, as shown in FIG. 4, the cyclone unit 300 comprises a grill body 340 having a connection passage 341 connected with the outflow passage 313; a shielding member 350 for shielding a lower part of the grill body 340; and blocking means 380.

The grill body 340 has a grill unit 342, the connection passage 341, and a shielding member connection unit 343. The grill unit 342 has a passage 344 of a predetermined type formed therein in order to prevent the dust from being drawn in but to secure the free inflow of the air. In the grill body 340 having the above construction, the connection passage 341 that opens upwardly is connected with the outflow passage 313. A lower opening of the grill body 340 is shielded by the shielding member 350.

A dust back-flow prevent unit 351 is formed at an outside of the circumferential direction of the shielding member 350. The dust back-flow prevent unit 351 converts a direction of the dust included in an air current that flows to the grill body 340 into the lower side of the cyclone unit 300.

Furthermore, a filter support unit 361 and filtering means 360 having a filter 362 can be installed at the shielding member 350. The filter support unit 361 is integrally formed with the shielding member 350, and the filter 362 is inserted in the filter support unit 361.

On the other hand, a locking lever 370 is disposed at a lower side of the grill body 340. A hinge shaft 345 protrudes from a lower side of the grill body 350. The locking lever 370 is rotatably connected with the hinge shaft 345 by a screw 346. Moreover, a locking lever connection unit 352 is disposed at a corresponding place to the locking lever 370 at the shielding member 350. A penetrating hole 352 for the locking lever 370 passing through is formed at the locking lever connection unit 352. A cam unit is formed around the penetrating hole 352, that is a lower side of the locking lever connection unit 352. In the above construction, if the user passes the locking lever 370 through the penetrating hole 353, and rotates the locking lever 370 by 90°, then the shielding member 350 is firmly secured to the grill body 340. In other words, without using a separate tool, the shielding member 350 can be installed to the grill body 340 and separated from the grill body 340. The construction and the operation of the locking lever 370 and locking lever connection unit 352 is described in further detail in Korean patent application number 2001-43286, thus the description will be omitted here.

The blocking means 380 prevents the dust collector 400 from being connected with the cyclone body 310, when the shielding member 350 is not assembled at the grill body 340. In other words, when the lower side of the grill body 340 is opened, the dust collector 400 can be assembled in the status that the shielding member 350 is not assembled. In this case, if the user operates the vacuum cleaner, the dust drawn into the cyclone unit 300 would directly flow into the motor driving unit through the lower opening of the grill body 340. Therefore, to prevent this kind of mistake in advance, the shielding member 380 is disposed. The shielding member 380 comprises a stopper pin 381 disposed at the grill body 340 in order to move upwardly and downwardly, and a spring 382 for flexibly urging the stopper pin 381 downwardly. The stopper pin 381 is accommodated in a guide unit 346 disposed in a length direction of the grill body 340, and can move upwardly and downwardly therein.

Figure 5:
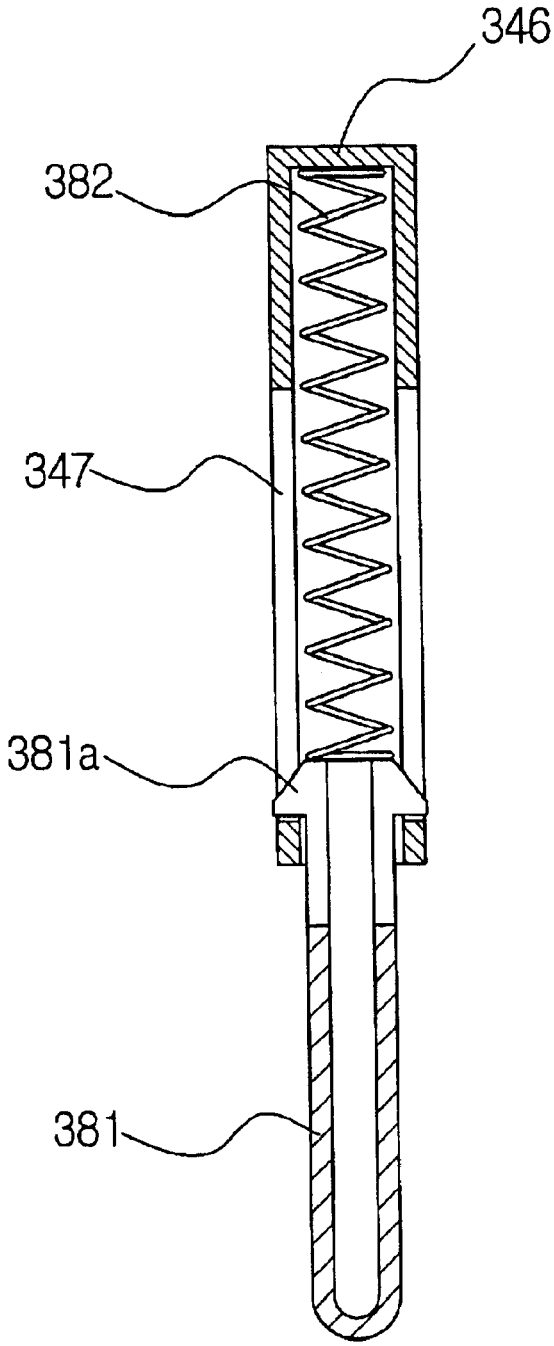
FIG. 5 is a sectional view showing an important part extracted from FIG. 4.

Referring to FIG. 5, a slot 347 for guiding the up and down movement of the stopper pin 381 is disposed in a length direction at the guide unit 346. In addition, a locking member 381*a* is disposed at an upper end of the stopper pin 381 in order to prevent the stopper pin 381 from being separated from the guide unit 347. The locking member 381*a* is connected with the slot 347. The upper end of the stopper pin 381 is partly cut. Thus, the stopper pin 381 can be connected with the guide unit 347 in the status that each locking member 381*a* becomes flexibly narrower.

Figure 6:
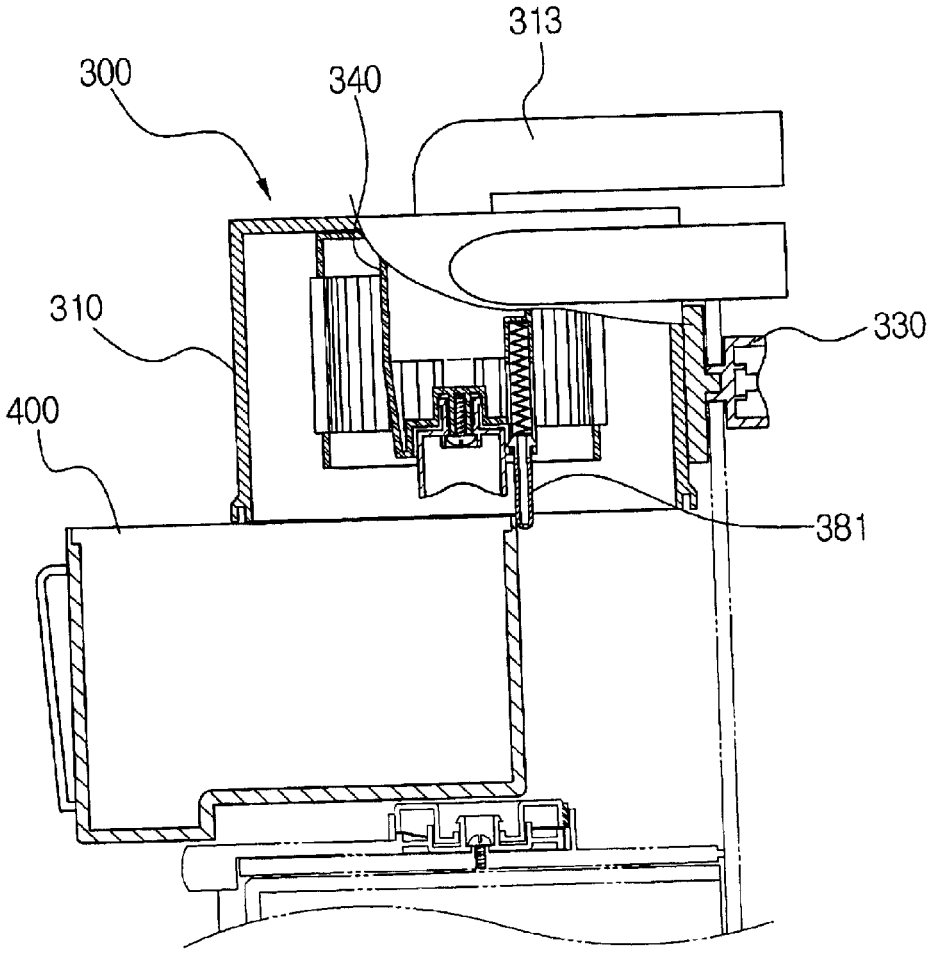
FIG. 6 is a schematic sectional view showing the operation of the cyclone dust collecting apparatus according to a preferred embodiment of the present invention.

The stopper pin 381 controls the horizontal movement of the dust collector 400 by being protruded for a lower end of the stopper pin 381 to be placed lower than a lower end of the cyclone body 310, when the stopper pin 381 goes down. Moreover, the stopper pin 381 is pushed by a shielding member 350 assembled to the grill body 340, and inserted into the guide unit 346 so that the dust collector 400 can be assembled. In other words, as shown in FIG. 6, when the shielding member 350 is separated from the grill body 340, the stopper pin 381 protrudes to the lower side of the grill body 340.

In this status, if the user horizontally moves the dust collector 400 to assemble the dust collector 400 to the cyclone body 310, the upper end of the dust collector 400 is locked at the stopper pin 381. Accordingly, the dust collector 400 is prevented from being assembled when the shielding member 350 is not assembled. Consequently, if the shielding member 350 is not installed, the user cannot operate the vacuum cleaner by mistake, and the dust is not separated in the cyclone body 310 or directly discharged to the motor driving unit.

In the meantime, as shown in FIG. 3, when the shielding member 350 is assembled at the grill body 340, the stopper pin 381 is accommodated into the guide unit 346 by the assembled shielding member 350. In this status, if the dust collector 400 is horizontally moved in an arrow direction, the dust collector 400 is placed at the lower part of the cyclone unit 300. Then, if the dust collector 400 goes up by the operation of the locking unit 500 that moves up and down, the dust collector 400 is assembled at the lower end of the cyclone body 310.

According to the cyclone dust collecting apparatus and the upright vacuum cleaner according to the present invention described so far, the dust collector 400 can be prevented from being assembled at the cyclone body 310 when the shielding member 350 is not assembled at the grill body 340. In other words, the dust collector 400 cannot be assembled when the shielding member 350 is not assembled. Thus, as the vacuum cleaner cannot be operated, consequently, dust cannot flow to the motor driving unit.

Therefore, the vacuum cleaner has less possibility of becoming damaged or out of order due to the introduction of dust to the motor driving unit, so that the security and the credibility of the vacuum cleaner will be increased.

So far, the preferred embodiment of the present invention has been illustrated and described. However, the present invention is not limited to the preferred embodiment described herein, and one of ordinary skill in the art can modify the present invention without departing from the true spirit and scope of the present claims.

What is claimed is:

1. A cyclone dust collecting apparatus for an upright vacuum cleaner, comprising:

a cyclone body that has upper and lower parts, inflow and outflow passages, and is removably connected with an upright vacuum cleaner body;

a grill body that has a lower opening and a connection passage for connecting to the outflow passage;

a shielding member removably connected to the grill body in order to shield the lower opening thereof;

a dust collector removably connected with the lower part of the cyclone body in order to collect dust that is separated in the cyclone body; and blocking means for preventing the dust collector from being connected to the cyclone body when the shielding member is not previously assembled with the grill body.

2. The cyclone dust collecting apparatus of claim 1, wherein the blocking means includes:

a stopper pin disposed at the grill body and capable of moving upwardly and downwardly in order to prevent the dust collector from moving horizontally, wherein the stopper pin protrudes to the lower end of the cyclone body when the stopper pin moves downwardly; and a spring for flexibly urging the stopper pin to move downwardly, wherein the stopper pin is pushed by the shielding member connected with the grill body to move upwardly.

3. The cyclone dust collecting apparatus of claim 2, wherein the grill body includes a guide unit for guiding the movement of the stopper pin and accommodating the spring.

4. The cyclone dust collecting apparatus of claim 3, wherein the guide unit has at least one slot formed therein, and a locking member, for connecting to the slot in order to prevent the stopper pin from separating therefrom, wherein the locking member protrudes from an outer side of the stopper pin.

5. An upright vacuum cleaner, comprising:

a cleaner body that has a settling unit, the settling unit has upper and lower parts, an outflow path connected with the motor driving unit, and an inflow path connected with a suction brush;

a cyclone unit having a cyclone body, removably connected with the settling unit, upper and lower parts, inflow and outflow passages and being installed at the settling unit in order to separate dust from an air drawn into through the inflow path and to discharge the clean air to the outflow path;

a dust collector removably connected to the lower part of the cyclone unit in order to collect the dust separated from the cyclone unit, wherein the cyclone unit further comprises:

a locking knob rotatably disposed at the cyclone body in order to be removably connected with a knob connection hole formed at an inside wall of the settling unit;

a grill body having a lower opening and a connection passage connected with the outflow passage;

a shielding member removably connected with the grill body in order to shield the lower opening of the grill body; and blocking means for preventing the dust collector from being connected with the cyclone body when the shielding member is not previously assembled with the grill body.

6. The upright vacuum cleaner of claim 5, wherein the dust collector is secured by a locking unit that moves upwardly and downwardly, and the locking unit is disposed at the lower part of the settling unit.

7. The upright vacuum cleaner of claim 5, which further comprises:

a locking lever rotatably disposed at the lower part of the grill body; and a penetrating hole formed at a corresponding part of the shielding member to allow the locking lever to pass therethrough.

8. An upright vacuum cleaner, comprising:

a cleaner body has an outflow path connected with the motor driving unit, and an inflow path connected with a suction brush;

a cyclone body that has upper and lower parts, inflow and outflow passages, and is removably connected with the cleaner body;

a grill body that has a lower opening and a connection passage for connecting to the outflow passage;

a shielding member removably connected to the grill body in order to shield the lower opening thereof;

a dust collector removably connected with the lower part of the cyclone body in order to collect dust that is separated in the cyclone body; and blocking means for preventing the dust collector from being connected to the cyclone body when the shielding member is not previously assembled with the grill body.

9. The upright vacuum cleaner of claim 8, wherein the blocking means includes:

a stopper pin disposed at the grill body and capable of moving upwardly and downwardly in order to prevent the dust collector from moving horizontally, wherein the stopper pin protrudes to the lower end of the cyclone body when the stopper pin moves downwardly; and a spring for flexibly urging the stopper pin to move downwardly, wherein the stopper pin is pushed by the shielding member connected with the grill body to move upwardly.

10. The upright vacuum cleaner of claim 8, wherein the grill body includes a guide unit for guiding the movement of the stopper pin and accommodating the spring.

11. The upright vacuum cleaner of claim 8, wherein the guide unit has at least one slot formed therein, and a locking member for connecting to the slot in order to prevent the stopper pin from separating therefrom, wherein the locking member protrudes from an outer side of the stopper pin.

* * * * *